United States Patent [19]

Drennan

[11] 4,154,880

[45] May 15, 1979

[54] LEADED GLASS PANE

[75] Inventor: Frank E. Drennan, Etobicoke, Canada

[73] Assignee: Dor Seal Limited, Toronto, Canada

[21] Appl. No.: 862,037

[22] Filed: Dec. 19, 1977

[51] Int. Cl.[2] ..... B44C 5/08

[52] U.S. Cl. ..... 428/38

[58] Field of Search ..... 428/38, 34

[56] References Cited

U.S. PATENT DOCUMENTS 1,524,998 2/1925 Russell ..... 428/38

3,713,958 1/1973 McCracken ..... 428/38

FOREIGN PATENT DOCUMENTS 1308134 2/1973 United Kingdom ..... 428/38

*Primary Examiner*—William R. Dixon, Jr.

*Attorney, Agent, or Firm*—Fetherstonhaugh & Co.

[57] ABSTRACT

A window pane or the like with a decorative moulding on a face thereof. The moulding is secured to the face of the window pane with an adhesive and is formed with locking flanges that mechanically lock with the adhesive to prevent its separation from the adhesive.

6 Claims, 6 Drawing Figures

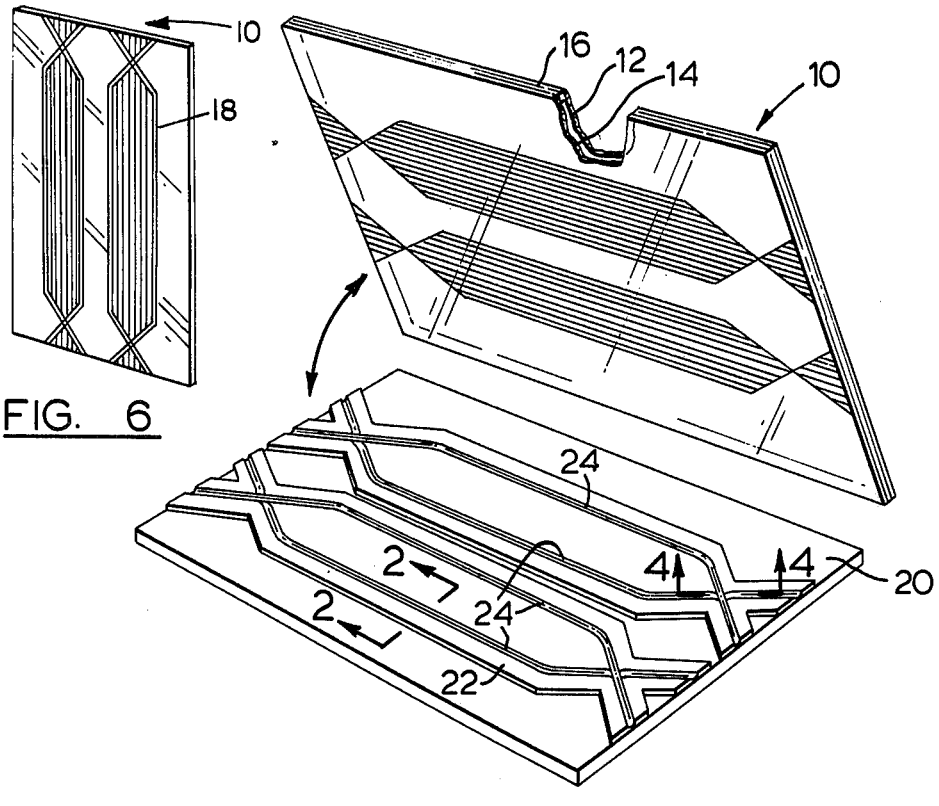
FIG. 6
FIG. 1
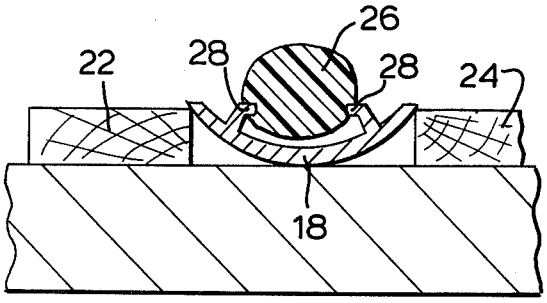
FIG. 2
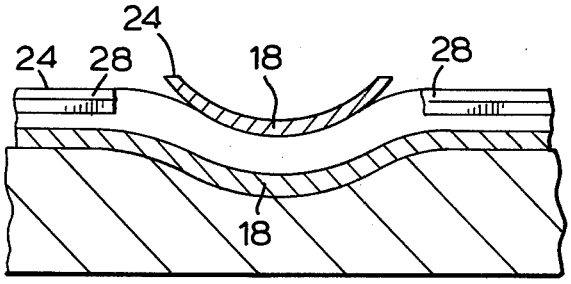
FIG. 4
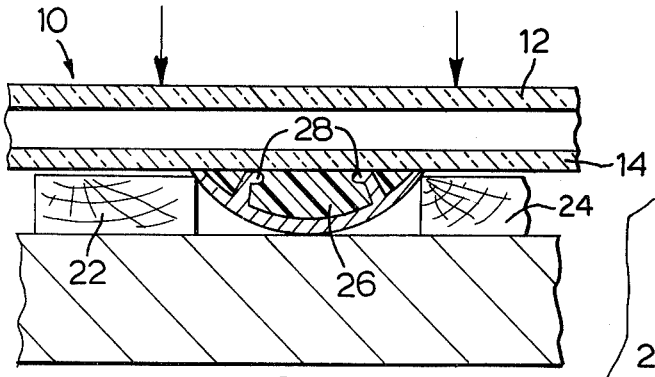
FIG. 3
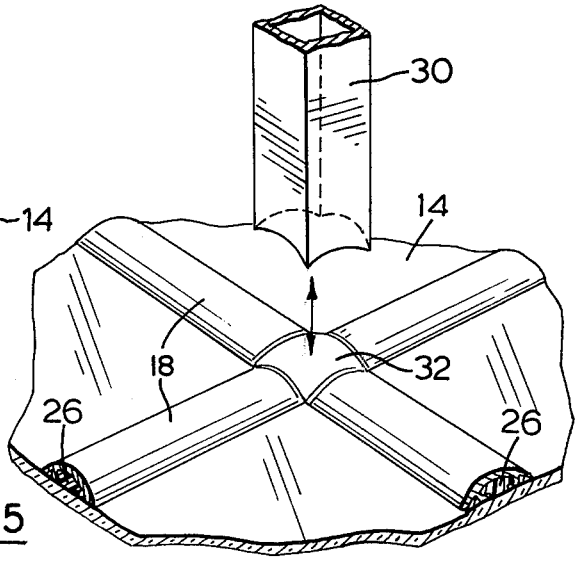
FIG. 5

LEADED GLASS PANE

This invention relates to a decorative window pane or the like and to a method of making it that has a lead or like moulding on at least one face thereof in a decorative configuration.

Leaded glass windows wherein pieces of glass are fitted together and supported by a lead came or moulding that has channels that contain the marginal edges of the fitted pieces are common. They have a very pleasing appearance and are popular. They are, however, costly and they suffer from the disadvantage that they cannot be made permanently weather-tight at the location of the mouldings.

The leakage of air and moisture at the lead moulding of a leaded glass window is a disadvantage that is especially objectionable where the leaded window pane is one of two spaced apart panes with an air space between them because moisture tends to leak past the glass and collect between the two panes.

Insulated window panes consisting of two sheets of glass spaced apart by a marginal spacer and with an air space between the panes for the purpose of forming an insulation are also very popular. They are popular because they serve the purpose of insulating a home or building against heat loss. Their popularity is increasing because of the rising cost of fuel.

It is common to ornament one of the panes of an insulated glass window and leaded glass has been used for this purpose. However, as indicated above, its tendency to leak has been a serious disadvantage. Attempts have been made to achieve the effect of a leaded glass window by adhesively securing a lead moulding to the outer face of a glass window rather than by piecing the glass between the moulding. These attempts have failed, however, because of the unavailability of an adhesive that will permanently adhere to glass and also to lead under exterior conditions. There are adhesives that will permanently adhere to glass under exterior conditions but the same adhesives will not permanently adhere to lead. There are, for example, the polysulphide glass sealants which are normally plastic and are caused to become rubbery and to adhere to a glass surface by the addition of a catalyst and the butyl hot melt adhesives which are normally rubbery can be softened by heat to cause them to adhere to glass and then permitted to cool and resume their rubbery consistency in permanent adhesion to a glass or like surface.

This invention overcomes the difficulty of securing a lead or like moulding to one face of a glass window for use in exterior weather conditions and it makes it possible to ornament an insulated glass window with a lead moulding that will not leak. While the invention is particularly useful for ornamenting double paned windows, its use is not restricted to double paned windows. It can be used on single pane windows, mirrors or the like.

It is, therefore, an object of this invention to provide a decorative window pane having a lead or like moulding overlying the outer face in a decorative configuration that will not leak in the location of the lead moulding even under exterior conditions and to provide a method of making such a decorative moulding.

With these and other objects in view a decorative pane according to this invention comprises a pane having an outer face; a moulding overlying said outer face of said pane in a decorative configuration; a body of adhesive securing said moulding to said outer face of said pane as aforesaid; said body of adhesive being in adhesive contact with said outer face of said pane and in a mechanical locked relation with said moulding.

The method of making a decorative pane according to the invention comprises the steps of laying a moulding in a jig in a decorative arrangement; mechanically interlocking a bead of adhesive to the underside of said moulding; pressing a pane and said adhesive together to adhesively secure said moulding to said pane; and removing said pane with said moulding adhered thereto. The invention will be clearly understood after reference to the following detailed specification read in conjunction with the drawings.

In the drawings:

FIG. 1 is a view of a jig with lead decorative mouldings arranged therein in a decorative configuration and an insulated glass window unit having a colour pattern on its outer face the outline of which corresponds with the configuration of the lead mouldings in the jig;

FIG. 2 is a sectional view along the line 2—2 of FIG. 1;

FIG. 3 is a view similar to FIG. 2 illustrating the manner in which the adhesive on the moulding is displaced as the patterned insulated window is caused to overlay the jig as viewed in FIG. 1;

FIG. 4 is a sectional view of the jig along lines 4—4 of FIG. 1;

FIG. 5 is an illustration of the manner in which the intersections of the moulding are formed after the window pane with the moulding adhered thereto is removed from the jig; and FIG. 6 is a perspective view of the window with lead moulding applied.

Referring to the drawings, the numeral 10 generally refers to an insulated window. It comprises two panes of glass 12 and 14 separated by a spacer 16 and held together by means of a polysulphide sealant that is well known in the window making art. The glass sealant is commercially available from various sources but one supplier known to this applicant who supplies the product is PRC Chemical Corporation of Canada Limited. Their trade identification is No. 428 Insulating Glass Sealant.

In use, the plastic polysulphide sealant is mixed with a catalyst and in a period of about eight hours cures to a rubber-like consistency to provide a very permanent bond between the spacers and the two layers of glass. The space between the two panes of glass provides good insulation against temperature differences between outside and inside of the unit.

Insulated window units of the type illustrated are common and it has become common practice to decorate them especially when used on doors. One form of decoration that is attractive is leading of one of the panes 12 or 14. The leading of glass, however, has given considerable difficulty because, as noted above, the conventional manner of leading glass tends to leak air and moisture and moisture tends to collect between the panes of glass if the pane leaks. Attempts to merely overlay a moulding of lead on the glass have failed because it has not been possible to provide proper adhesion between the lead and adhesive.

With this invention, a lead or like moulding 18 having a cross-section as illustrated in FIG. 2 is laid in the channel of the jig 20 that is formed between the runners 22 and 24. Runners 22 and 24 as seen in FIG. 1 are arranged such that the channels defined thereby make up the decorative pattern that is to be applied to the outer face of the window unit 10.

As indicated, the moulding 18 is secured to the face of the window pane by means of an adhesive 26. This adhesive is plastic when applied but cures to a firm rubber-like consistency under the action of a catalyst that is added thereto after about eight hours to provide a secure bond. The adhesive is first extruded from a nozzle into the channel formed at the underside of the moulding 18 as illustrated in FIG. 2. It will be noted that the sides of the adhesive channel have inwardly directed flanges 28 which form a mechanical interlock with the adhesive against removal of the moulding from the adhesive in the finished product.

The outer face of the window unit 10 preferably has a pattern that is similar to the pattern defined by the mouldings in the jig 20. This pattern can be defined in many ways, for example, adjacent areas can be different colours or have different surface effects, such as can be obtained by sand blasting to a pattern.

The window unit 10 is applied to the jig 20 after the adhesive has been applied to the underside of the mouldings 18 and, as pressure is applied, the adhesive is pressed into a configuration similar to that illustrated in FIG. 3. Once pressed into location, the window unit 10 is removed from the jig with the moulding 18 secured thereto to provide a decorative moulding configuration on the outer face of the window unit.

Once the adhesive cures, the moulding is permanently mounted on the outer face of the window pane 14. The adhesive makes a permanent bond to the glass and the mechanical interlock of the moulding and the adhesive results in a permanent bond of the moulding to the adhesive.

FIG. 4 illustrates the manner in which the moulding 18 is formed at the intersections of the moulding in the jig. The inwardly extending members that form the channels for the adhesive are removed on both mouldings at the intersection and after the window unit is removed from the jig the lead metal of the moulding is formed with a punch-like forming tool 30 to provide a neat rounded appearance as at 32.

The rubbery adhesive glass sealant 26 is coloured with an aluminum powder so that its resultant colour is very similar to the colour of the lead moulding. Thus, on viewing the window unit from behind, one does not see a discontinuity of colour as between the metal of the moulding and the adhesive. Alternatively, one can paint a lead coloured strip on the back side of the glass. In many cases, the colour of the adhesive as viewed from the back side of the window unit is not important because the back pane 12 of the window unit is often frosted or coloured. Even in cases where the back pane of the unit is clear, however, the appearance of the sealant as viewed from the back need not be objectionable if the sealant is coloured or a coloured strip is made on the back face of the pane. Similar considerations apply to single pane windows or mirrors.

The glass sealant is as noted above relatively free flowing when applied to the channel of the moulding and has poor adhesive qualities but under the action of a catalyst it adheres to the glass and takes a permanent set to a rubbery consistency with sufficient resiliency to expand and contract with the glass under conditions of exterior use. It is contemplated that a hot melt glass adhesive could be used. These adhesives are well known. They normally have a rubbery consistency but can be made to flow and assume close contact with a sheet of glass by the application of heat. When they cool they adhere to the glass and reassume their rubbery resilient but non-plastic characteristic. Their resiliance in resetting permits them to expand and contract with the glass but maintain adhesive contact. These glass adhesives and their use on glass are well known in the window art.

Embodiments of the invention other than the one illustrated will be apparent to those skilled in the art. For example, the particular form of the mechanical interlock of the moulding and adhesive is not critical nor is the particular way of mounting the moulding on the glass critical.

In cases where the front face of the glass is differently coloured from area to area a moulding is necessary between the differently coloured areas to achieve a neat appearance. With this invention the final effect in such a case is the effect of a leaded glass window made with channeled cames of the prior art and glass pieces of different colours. Different colour effects can be applied to a window pane with silk screening processes. This process is relatively inexpensive so that the invention makes available a coloured leaded glass window at an inexpensive price that will achieve a perfect seal at the moulding.

What I claim as my invention is:

1. A decorative pane comprising a pane having an outer face; a moulding overlying said outer face of said pane in a decorative configuration; a body of adhesive between the undersurface of said moulding and said outer face of said pane as aforesaid; said body of adhesive being in adhesive contact with said outer face of said pane and in mechanical locked relation with the undersurface of said moulding whereby to lock the moulding against displacement from the outer face of said pane.

2. A decorative pane as claimed in claim 1 wherein said moulding is metal.

3. A decorative pane as claimed in claim 1 wherein said moulding is lead.

4. A decorative pane as claimed in claim 1 wherein said moulding has its undersurface formed with a channel that has laterally directed adhesive locking flanges to achieve said mechanical locked relation with said body of moulding.

5. A decorative pane as claimed in claim 2 wherein said moulding has its undersurface formed with a channel that has laterally directed adhesive locking flanges to achieve said mechanical locked relation with said body of moulding.

6. A decorative pane as claimed in claim 3 wherein said moulding has its undersurface formed with a channel that has laterally directed adhesive locking flanges to achieve said mechanical locked relation with said body of moulding.

* * * * *